US006067693A

United States Patent [19]

Chen

[11] Patent Number: 6,067,693

[45] Date of Patent: May 30, 2000

[54] CLAMP WITH A PAIR OF SEPARABLE AND ADJUSTABLE ARMS

[76] Inventor: Shi-Jia Chen, 201 Allen St., New York, N.Y. 10002

[21] Appl. No.: 09/407,239

[22] Filed: Sep. 28, 1999

[51] Int. Cl.[7] ..... A44B 21/00; B25B 1/00

[52] U.S. Cl. ..... 24/514; 24/569; 24/525; 269/147

[58] Field of Search ..... 24/514, 525, 542, 24/569; 269/140, 142, 145, 147, 240, 243, 249

[56] References Cited

U.S. PATENT DOCUMENTS 2,604,352 7/1952 Gonser ..... 24/525 X
2,973,792 3/1961 Fonken ..... 269/147 X
3,934,316 1/1976 Driscoll ..... 24/569 X
5,568,915 10/1996 Raymond ..... 269/147

*Primary Examiner*—James R. Brittain
*Assistant Examiner*—Robert J. Sandy
*Attorney, Agent, or Firm*—Goldstein & Canino

[57] ABSTRACT

A clamp with a pair of separable and adjustable arms including a main member. A pair of arms are adjustable coupled with the main member. The pair of arms each have an inner collar portion adapted for adjustable coupling with the main member. A pair of fingers are adjustably coupled with respect to the pair of arms. The pair of fingers each have a threaded rod receivable within the threaded apertures of the pair of arms.

6 Claims, 3 Drawing Sheets

CLAMP WITH A PAIR OF SEPARABLE AND ADJUSTABLE ARMS

BACKGROUND OF THE INVENTION

The present invention relates to a clamp with a pair of separable and adjustable arms and more particularly pertains to a clamp which is useable in places with limited space.

Typical clamping devices are generally provided with one fixed arm and one adjustable arm. This affords the user some flexibility, but ultimately limits the ability for the clamp to be used in certain areas. These clamps typically allow for the securement of some movable object to a fixed object whereby the clamp generally extends over a side of the fixed object and is then tightened over the movable object to couple the movable object to the fixed object. However, this limits the use of the clamp to areas adjacent to the sides of the fixed object. What is needed is a device that is completely adjustable so that nearly any application is possible.

The present invention seeks to provide a solution to this problem by providing a device that which has components that are completely separable for use in areas that standard clamps are incapable of being utilized.

The use of clamping tools is known in the prior art. More specifically, clamping tools heretofore devised and utilized for the purpose of retaining objects with respect to a fixed surface are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,247,090 to Hahn discloses a clamp assembly with two jaws that have independently adjustable screws. U.S. Pat. No. 2,716,911 to Focke discloses a vice with a stationary jaw and moveable jaw. U.S. Pat. No. 360,974 to Shaw discloses a pair of clamps supported on a bar with one side attached to a beam and the other jaw being carried along the slide.

While these devices fulfill their respective, particular objective and requirements, the aforementioned patents do not describe a clamp with a pair of separable and adjustable arms for providing greater flexibility to allow for use of the clamp in places with limited space.

In this respect, the clamp with a pair of separable and adjustable arms according to the present invention substantially departs from the conventional concepts and designs of the prior art, and in doing so provides an apparatus primarily developed for the purpose of providing greater flexibility to allow for use of the clamp in places with limited space.

Therefore, it can be appreciated that there exists a continuing need for a new and improved clamp with a pair of separable and adjustable arms which can be used for providing greater flexibility to allow for use of the clamp in places with limited space. In this regard, the present invention substantially fulfills this need.

SUMMARY OF THE INVENTION

In the view of the foregoing disadvantages inherent in the known types of clamping tools now present in the prior art, the present invention provides an improved clamp with a pair of separable and adjustable arms. As such, the general purpose of the present invention, which will be described subsequently in greater detail, is to provide a new and improved clamp with a pair of separable and adjustable arms and method which has all the advantages of the prior art and none of the disadvantages.

To attain this, the present invention essentially comprises a main member having a generally elongated rectangular configuration. The main member has short upper and lower ends and long opposed sides. The long opposed sides each have a plurality of inwardly extending recesses therein along a length thereof in a spaced relationship. A pair of arms are adjustably coupled with the main member. The pair of arms each have an inner collar portion adapted for adjustable coupling with the main member. The inner collar portion has a central opening for sliding vertically with respect to the main member in a first orientation. The central opening has inwardly extending teeth whereby rotation of the arms ninety degrees with respect to the main member into a second orientation will fixedly engage the arms to the main member in said second orientation. Each of the arms have an outer portion with a pair of threaded apertures therethrough. A pair of fingers are adjustably coupled with respect to the pair of arms. The pair of fingers each have a threaded rod receivable within the threaded apertures of the pair of arms. Inner ends of the threaded rods each have a disk rotatably coupled thereto. The disks allow engagement of the surface to be clamped. Each of the threaded rods have a bore extending through an outer end thereof for receiving an adjustable handle to facilitate adjustment of the threaded rods with respect to the threaded apertures to allow the disks to meet the clamped surface.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved clamp with a pair of separable and adjustable arms which has all the advantages of the prior art clamping tools and none of the disadvantages.

It is another object of the present invention to provide a new and improved clamp with a pair of separable and adjustable arms which may be easily and efficiently manufactured and marketed.

It is a further object of the present invention to provide a new and improved clamp with a pair of separable and adjustable arms which is of durable and reliable construction.

An even further object of the present invention is to provide a new and improved clamp with a pair of separable and adjustable arms which is susceptible of a low cost of manufacture with regard to both materials and labor, and which accordingly is then susceptible of low prices of sale to the consuming public, thereby making such a clamp with a pair of separable and adjustable arms economically available to the buying public.

Even still another object of the present invention is to provide a new and improved clamp with a pair of separable and adjustable arms for providing greater flexibility to allow for use of a clamp in places with limited space.

Lastly, it is an object of the present invention to provide a new and improved clamp with a pair of separable and adjustable arms including a main member. A pair of arms are adjustably coupled with the main member. The pair of arms each have an inner collar portion adapted for adjustable coupling with the main member. A pair of fingers are adjustably coupled with respect to the pair of arms. The pair of fingers each have a threaded rod receivable within the threaded apertures of the pair of arms.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various drawing figures.

DESCRIPTION OF THE PREFERRED EMBODIMENT

Figure 1:
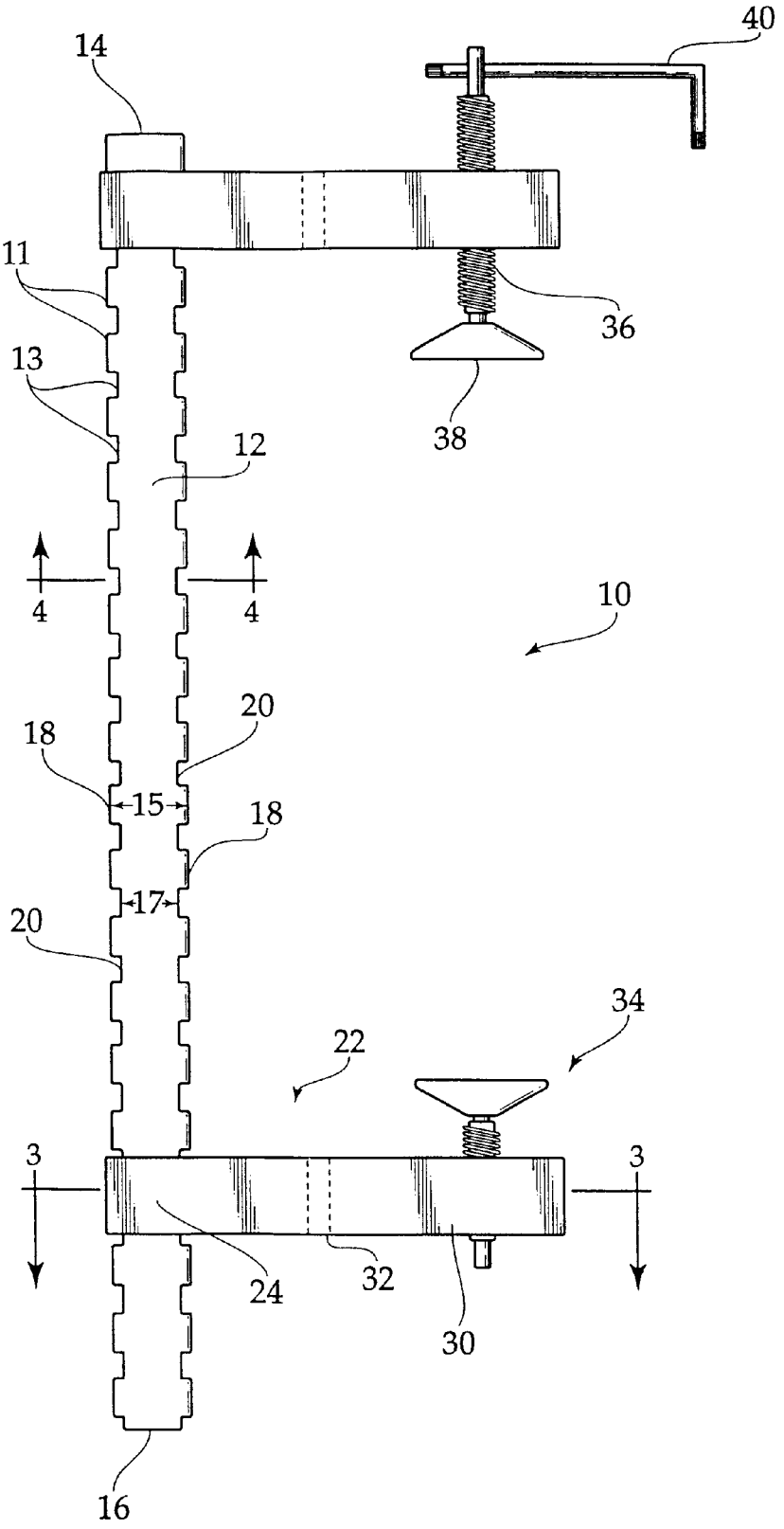
FIG. 1 is a perspective view of the preferred embodiment of the clamp with a pair of separable and adjustable arms constructed in accordance with the principles of the present invention.
Figure 2:
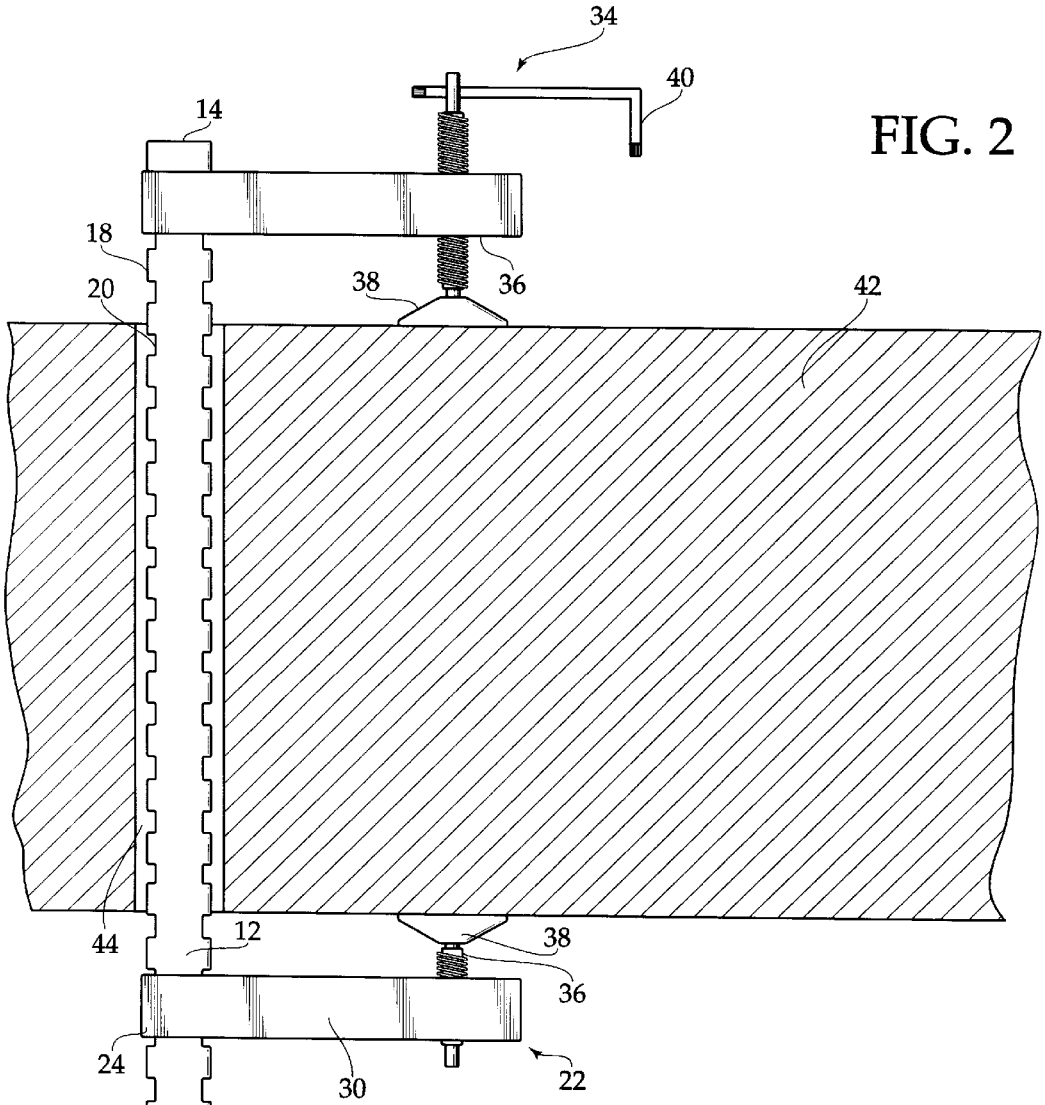
FIG. 2 is a side view of the present invention illustrated with the main member extending through a hole with the arms disposed on opposing ends and clamped to opposed surfaces of a work surface.
Figure 3:
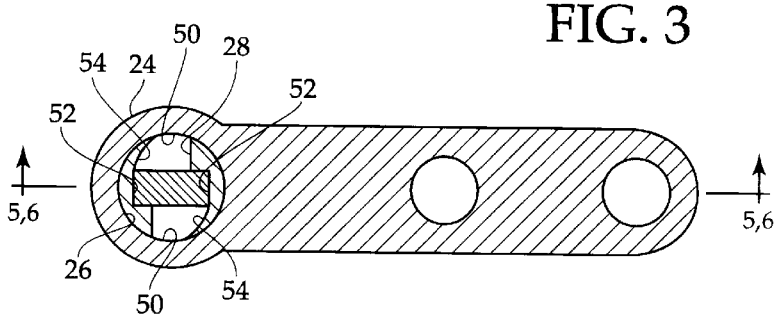
FIG. 3 is a cross-sectional view of the arm of the present invention as taken along line 3—3 of FIG. 1, with parts removed for clarity.
Figure 4:
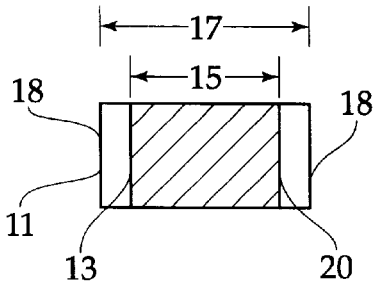
FIG. 4 is a cross sectional view of the main member, taken generally along line 4—4 in FIG. 1.

With reference now to the drawings, and in particular, to FIGS. 1 through 3 thereof, the preferred embodiment of the new and improved clamp with a pair of separable and adjustable arms embodying the principles and concepts of the present invention and generally designated by the reference number 10 will be described.

Specifically, it will be noted in the various Figures that the device relates to a clamp with a pair of separable and adjustable arms for providing greater flexibility to allow for use of a clamp in places with limited space. In its broadest context, the device consists of a main member, a pair of arms, and a pair of fingers. Such components are individually configured and correlated with respect to each other so as to attain the desired objective.

The main member 12 has a generally elongated rectangular configuration. The main member 12 has short upper and lower ends 14,16 and long opposed sides 18. The long opposed sides 18 each have a plurality of inwardly extending recesses 20 therein along a length thereof in a spaced relationship, creating a plurality of major portions 11, separated by a plurality of minor portions 13. The long opposite sides 18 are separated by a major distance 15. The inwardly extending recesses 20 therein are separated by a minor distance 17.

The pair of arms 22 are adjustably coupled with the main member 12. The pair of arms 22 each have an inner collar 24 portion adapted for adjustable coupling with the main member 12. The inner collar portion 24 has a central opening 26 for sliding vertically with respect to the main member 12 in a first orientation. The central opening 26 has an inwardly extending flange 28 whereby rotation of the arms 22 ninety degrees with respect to the main member 12 into a second orientation will fixedly engage the arms 22 to the main member 12 in said second orientation.

Referring to FIG. 3, the inwardly extending flange 28 has a pair of wide opposite sides 50, and a pair of narrow opposite sides 52. The wide opposite sides 50 are separated by a distance substantially equal to the major distance of the main member, and thus allow the main member 12 to extend vertically therebetween when the long opposed sides of the main member are aligned therewith. The narrow opposite sides 52 are separated by a distance substantially equal to the minor distance 17 of the main member. The wide opposite sides 50 are offset around the central opening 26 from the narrow opposite sides 52 by ninety degrees. A pair of guide curves 54 are defined in the inwardly extending flange 28, each extending from one of the narrow opposite sides 52 to one of the wide opposite sides 50 to smooth rotation of the minor portion of the main member 12.

Figure 5:
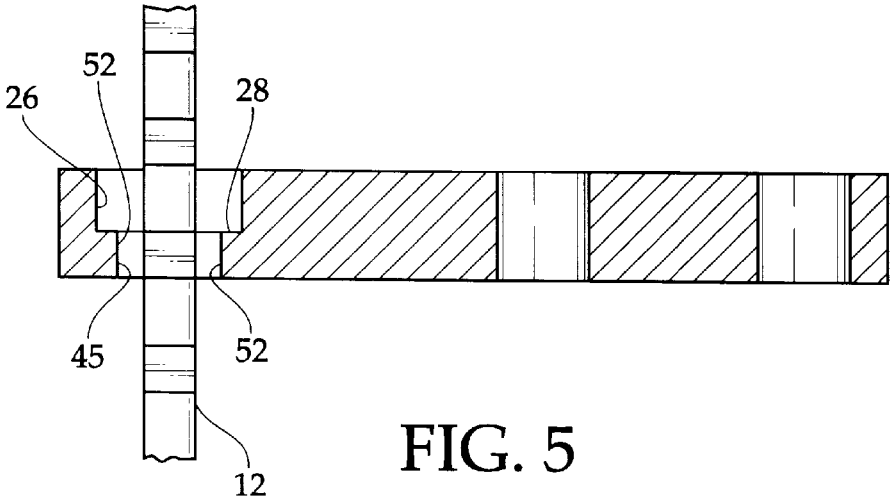
FIG. 5 is a cross sectional view of one of the arms, taken generally along line 5—5 in FIG. 4, except wherein the main member has been rotated ninety degrees.

Referring to FIG. 5, opening 26 of the arm has a lower portion 45. The lower portion 45 is always the part of the arm 22 which is nearest to the other arm 22 which is attached onto an opposite side of the main member 12. The inwardly extending flange 28 is present in the lower portion 45 of the opening. In a first position illustrated in FIG. 5, the main member is capable of extending fully through the opening 26. However the narrow opposite sides 52 would not allow the major portion of the main member to extend through the opening 26 if the main member 12 were rotated ninety degrees.

Figure 6:
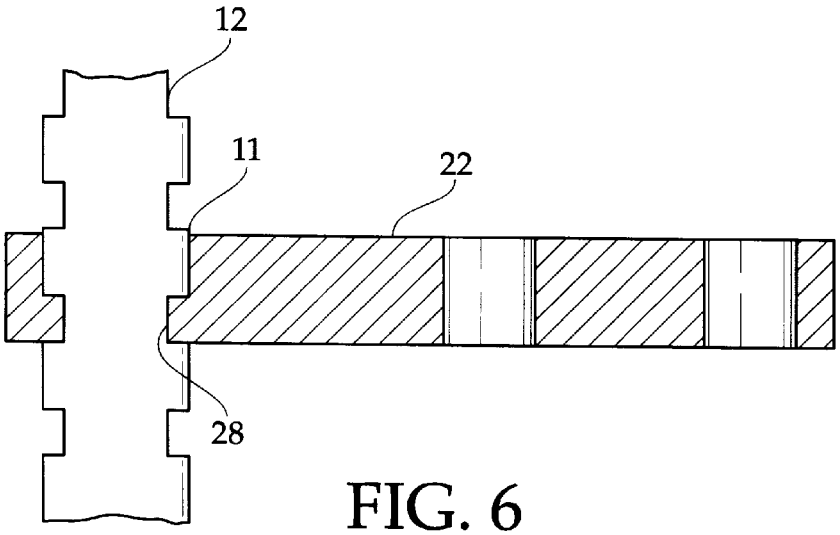
FIG. 6 is a cross sectional view of one of the arms, taken generally along line 6—6 in FIG. 4.

Once the arm 22 and the main member 12 has been appropriately positioned, the main member is rotated ninety degrees into the second position, as shown in FIG. 6. In this position, the inwardly extending flange 28 prevents the major portion 11 of the main member 12 from moving in the opening 26. Accordingly, the arm 22 is locked in place.

Each of the arms 22 have an outer portion 30 defined by a pair of threaded apertures 32 therethrough. The pair of fingers 34 are adjustably coupled with respect to the pair of arms 22. The pair of fingers 34 each have a threaded rod 36 receivable within the threaded apertures 32 of the pair of arms 22. Inner ends of the threaded rods 36 each have a disk 38 rotatably coupled thereto. Each of the threaded rods 36 have a bore extending through an outer end thereof for receiving an adjustable handle 40 to facilitate adjustment of the threaded rods 36 with respect to the threaded apertures 32.

A typical use of the present invention is illustrated in FIG. 2. In this use, a working surface 42 is provided. A hole 44 extends through the working surface to allow the main member 12 to be passed therethrough. Once through the hole 44, the arms 22 are secured to the main member 12 on opposing surfaces of the working surface 42 by rotating the main member 12. The adjustable handle 40 is then coupled with one of the threaded rods 36 and rotated so that threaded rod 36 will move closer to the working surface 42 until the disks 38 are tightly engaged against the opposing sides of the working surface.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A clamp with a pair of separable and adjustable arms for providing greater flexibility to allow for use of a clamp in places with limited space comprising, in combination:

a main member having a generally elongated rectangular configuration, the main member having short upper and lower ends and long opposed sides, the long opposed sides each having a plurality of inwardly extending recesses therein along a length thereof in a spaced relationship of major portions and minor portions;

a pair of arms adjustably coupled with the main member, the pair of arms each having an inner collar portion adapted for adjustable coupling with the main member, the inner collar portion having a central opening for sliding vertically with respect to the main member in a first orientation, the central opening having an inwardly extending flange whereby rotation of the arms ninety degrees with respect to the main member will fixedly engage the arms to the main member in a second orientation, each of the arms having an outer portion defined by a pair of threaded apertures therethrough;

a pair of fingers adjustably coupled with respect to the pair of arms, the pair of fingers each having a threaded rod receivable within the threaded apertures of the pair of arms, inner ends of the threaded rods each having a disk rotatably coupled thereto, each of the threaded rods having a bore extending through an outer end thereof for receiving an adjustable handle to facilitate adjustment of the threaded rods with respect to the threaded apertures.

2. A clamp with a pair of separable and adjustable arms for providing greater flexibility to allow for use of a clamp in places with limited space comprising, in combination:

a main member;

a pair of arms adjustably coupled with the main member, the pair of arms each having an inner collar portion adapted for adjustable coupling with the main member, each of the arms having an outer portion defined by a pair of threaded apertures therethrough;

a pair of fingers adjustably coupled with respect to the pair of arms, the pair of fingers each having a threaded rod receivable within the threaded apertures of the pair of arms.

3. The clamp with a pair of separable and adjustable arms as set forth in claim 2 wherein the main member has a generally elongated rectangular configuration, the main member having short upper and lower ends and long opposed sides, the long opposed sides each having a plurality of inwardly extending recesses therein along a length thereof in a spaced relationship which form alternating major portions and minor portions.

4. The clamp with a pair of separable and adjustable arms as set forth in claim 3 wherein the inner collar portion having a central opening for sliding vertically with respect to the main member in a first orientation, the central opening having an inwardly extending flange whereby rotation of the arms ninety degrees with respect to the main member will fixedly engage the arms to the main member in a second orientation.

5. The clamp with a pair of separable and adjustable arms as set forth in claim 2 wherein inner ends of the threaded rods each have a disk rotatably coupled thereto.

6. The clamp with a pair of separable and adjustable arms as set forth in claim 2 wherein each of the threaded rods have a bore extending through an outer end thereof for receiving an adjustable handle to facilitate adjustment of the threaded rods with respect to the threaded apertures.

* * * * *